US011511778B2

(12) United States Patent
Kukulski et al.

(10) Patent No.: US 11,511,778 B2
(45) Date of Patent: Nov. 29, 2022

(54) JOINT ARRANGEMENT AND METHOD FOR ENERGY CONVERSION

(71) Applicant: Axtone S.A., Kanczuga (PL)

(72) Inventors: Jan Kukulski, Kosina (PL); Leszek Wasilewski, Gniewczyna (PL)

(73) Assignee: Axtone S.A, Kanczuga (PL)

( * ) Notice: Subject to any disclaimer, the term of this patent is extended or adjusted under 35 U.S.C. 154(b) by 325 days.

(21) Appl. No.: 16/632,315

(22) PCT Filed: Jun. 28, 2018

(86) PCT No.: PCT/EP2018/067345
§ 371 (c)(1),
(2) Date: Jan. 17, 2020

(87) PCT Pub. No.: WO2019/002427
PCT Pub. Date: Jan. 3, 2019

(65) Prior Publication Data

US 2020/0164903 A1 May 28, 2020

(30) Foreign Application Priority Data

Jun. 28, 2017 (DE) ..... 102017114376.9

(51) Int. Cl.
*B61F 5/50* (2006.01)

(52) U.S. Cl.
CPC ..... *B61F 5/50* (2013.01)

(58) Field of Classification Search
CPC ..... B61F 5/00; B61F 5/02; B61F 5/04; B61F 5/06; B61F 5/08; B61F 5/122; B61F 5/38; B61F 5/50
See application file for complete search history.

(56) References Cited

FOREIGN PATENT DOCUMENTS

| | | | | |
|---|---|---|---|---|
| CH | 452586 | A | 3/1968 | |
| DE | 102012103426 | A1 | 10/2013 | |
| EP | 1724176 | A1 | 11/2006 | |
| EP | 1884434 | A1 | 2/2008 | |
| EP | 2048407 | B1 | 11/2010 | |
| WO | 2005023619 | A1 | 3/2005 | |
| WO | 2016139596 | A1 | 9/2016 | |
| WO | WO-2016139596 | A1 * | 9/2016 | ..... B61G 11/16 |

* cited by examiner

*Primary Examiner* — Robert J McCarry, Jr.
(74) *Attorney, Agent, or Firm* — Mannava & Kang, P.C.

(57) ABSTRACT

Joint arrangement (10) for a truck comprising at least one deformation element (12.1, 12.2), wherein the deformation element comprises at least one rod (14.1, 14.2) and a connection plate (16.1, 16.2), wherein the connection plate is arranged on the rod, wherein the rod has at least one stop element. The connection plate can be displaced on the rod in the longitudinal direction of said rod, wherein a deformation work can be performed on the deformation element in the event of a displacement of the connection plate on the rod; and wherein a displacement path of the connection plate on the rod is limited by the stop element (24.1, 24.2). Further a method for energy conversion is proposed.

18 Claims, 7 Drawing Sheets

JOINT ARRANGEMENT AND METHOD FOR ENERGY CONVERSION

Figure 1:
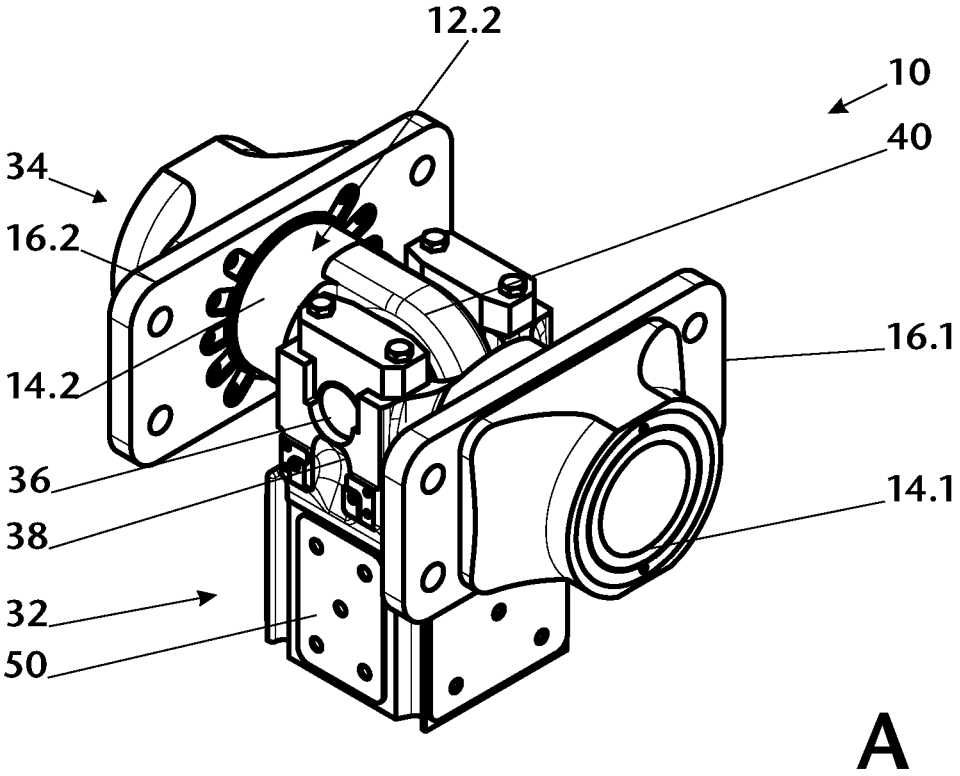
Figure 1:
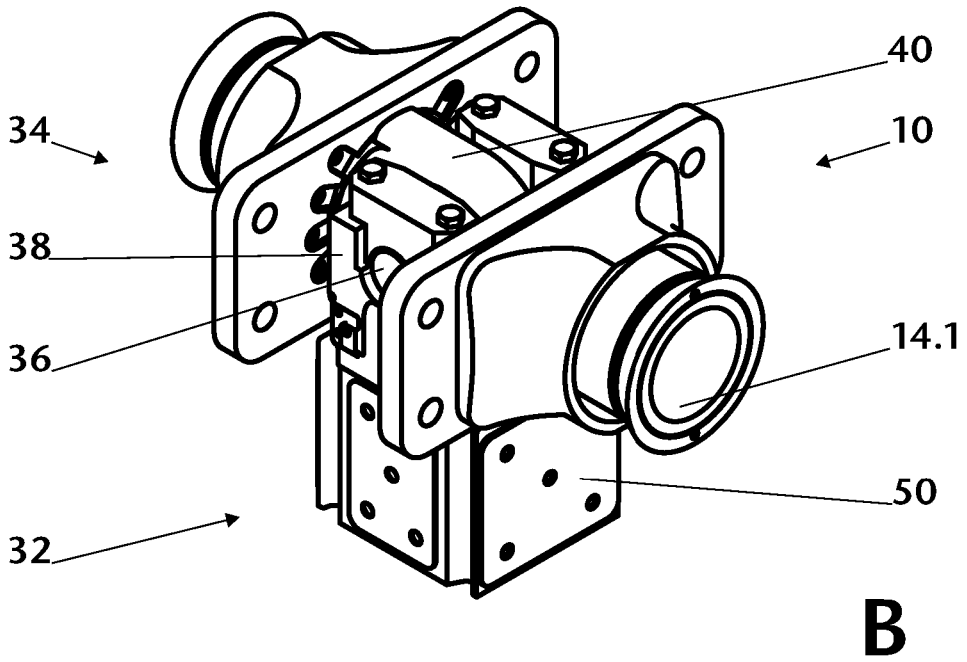

The invention relates to a joint arrangement for a truck comprising at least one deformation element, as well as to a method for energy conversion by means of a truck comprising a joint arrangement.

Joint arrangements for trucks are known in general from the prior art. For example, EP 1 884 434 B1 describes a joint arrangement for the articulated connection of two adjacent car bodies of a rail vehicle, in particular in interaction with a truck.

WO 2016/139596 A1 describes an energy-absorbing element having two parallel rods on which cutting tools are arranged. Upon introduction of force via a thrust element into the rod, the cutting tools take a chip off of said rod.

The known joint arrangements with deformation elements for conversion of movement energies in the event of an accident normally have a high weight. Furthermore, the energy conversion in the course of the deformation of the deformation element is difficult to set or control in advance.

It is the object of the invention to provide an improved joint arrangement and a method for energy conversion. In particular, the object is to provide a joint arrangement having low weight.

According to the invention, the object is achieved by means of a joint arrangement for a truck comprising at least one deformation element, wherein the deformation element comprises at least one rod and a connection plate, wherein the connection plate is arranged on the rod, wherein the rod has at least one stop element; the connection plate can be displaced on the rod in the longitudinal direction of said rod, wherein a deformation work can be performed on the deformation element in the event of a displacement of the connection plate on the rod; and wherein a displacement path of the connection plate on the rod is limited by the stop element. Furthermore, according to the invention the object is achieved by means of a method for energy conversion by means of a joint arrangement for a truck, characterized in that the joint arrangement comprises at least one deformation element, wherein the deformation element comprises at least one rod and a connection plate, wherein the rod has at least one stop element; the connection plate is displaced on the rod in the longitudinal direction of said rod, wherein a deformation work can be performed on the deformation element in the event of a displacement of the connection plate on the rod; and wherein a displacement path of the connection plate on the rod is limited by the stop element. Further advantageous embodiments are to be learned from the following description, the figures, and the dependent claims. However, the individual features of the described embodiments are not limited to these, but rather may be linked amongst each another and with other features to form additional embodiments.

A joint arrangement for a truck, comprising at least one deformation element, is proposed, wherein the deformation element comprises at least one rod and a connection plate, wherein the connection plate is arranged so that it can be displaced on the rod. The rod has at least one stop element. The connection plate can be displaced on the rod in the longitudinal direction of said rod, wherein a deformation work can be performed on the deformation element in the event of a displacement of the connection plate on the rod, and wherein a displacement path of the connection plate on the rod is limited by the stop element.

In particular, the connection plate can be displaced at least in part in the longitudinal direction of the rod by means of an introduction of force. In one embodiment, it is provided that, in the event of a force introduction into the connection plate, a flow of force can be conducted at least partially from the connection plate directly into the rod.

In one embodiment, the connection plate comprises at least one cutting tool by means of which at least one chip can be removed from the rod upon displacement of the connection plate on said rod. In one embodiment, the flow of force is provided as starting from the connection plate, proceeding via the cutting tool into the rod. In a further embodiment, it is provided that, after the displacement of the connection plate by a maximum displacement path, the flow of force is provided as starting from the connection plate, proceeding via the cutting tool into the rod. In a further embodiment, it is provided that, after the displacement of the connection plate by a maximum displacement path, the flow of force is provided at least partially, starting from the connection plate, and proceeding directly into the rod. In one embodiment, the truck is a Jacobs bogie.

In the sense of the invention, a maximum displacement path is the path by which the connection plate is displaced on the rod after an accident, a maximum force introduction that is to be expected, or a maximum impulse to be expected. In one embodiment, the maximum displacement path cannot be determined exactly in advance, since an in particular constant increase in a displacement resistance does not permit an exact determination in advance. In particular, the displacement resistance is at least partially influenced by a cutting resistance. It is advantageous in regard to the indefinite maximum displacement path that, in the event of a force introduction or an impulse introduction into the connection plate that is greater than the force or impulse introduction that is to be expected, a displacement and thus a deformation of the deformation element will still take place. In this way, an energy conversion may still take place at least in part even if energy conversion capacities are already nearly exhausted.

Relative to the embodiment known from the prior art, in particular WO 2016/139536 A1, the present invention has the advantage that it may take a significantly more compact form. Fewer individual components are required in order to equip the joint arrangement with a deformation element. In particular, weight is hereby saved relative to the solutions known from the prior art. Furthermore, in the embodiment proposed in WO 2016/139536 A significantly longer rod is to be allowed for, since a striking of cutting tools on a mounting plate must be absolutely prevented. If the cutting tools strike the mounting plate in the event of an accident or of a high force introduction, peak stresses will occur that make it impossible to calculate a behavior of the joint arrangement. By contrast, via the provision of the in particular materially joined stop element on the rod, the proposed joint arrangement allows an adjustment of the deformation in the event of a defined introduction of force into the joint arrangement. In the case of very high force introductions, a controlled deformation may preferably be set via a corresponding design of the stop element. In particular, a striking of components against one another, for example of the cutting element against a mounting plate, a joint fork and/or a joint eye, may be safely prevented.

The joint arrangement can preferably be arranged between two cars of a rail vehicle. The connection plate also can preferably be arranged on a car. In a further embodiment, it is provided that a force is introduced from the car body into the connection plate, in particular in the event of an accident. In particular, the force introduction is at least 400 kN to approximately 3000 kN so that a displacement of the connection plate on the rod takes place.

If the term "approximately" is used in connection with values or value ranges within the scope of the invention, what is to be understood by this is a tolerance range which the person skilled in the art in this field considers to be typical; in particular, a tolerance range of ±20%, preferably ±10%, more preferably ±56% is provided.

In one embodiment, the rod is designed as a pull rod and/or push rod. In a further embodiment, the rod is designed to be at least partially hollow. In one embodiment, the rod is designed as a tube. The rod is in particular round in cross-section. In a further embodiment, the rod is designed to be essentially rectangular in cross-section.

The term "essentially" indicates a tolerance range that is acceptable from economic and technical points of view to the person skilled in the art so that the corresponding feature is still to be recognized or realized as such.

The connection plate preferably comprises a recess. The rod furthermore preferably passes through the recess. In a further embodiment, the connection plate is arranged on the rod by means of an interference fit. Furthermore, the rod preferably passes through a center of gravity of the connection plate.

The deformation element comprises at least one connection plate and the rod. In particular, the connection plate is arranged on the rod such that this, in the event of an impulse or force introduction on the connection plate, is displaced on the rod, in particular in the event of an accident.

The connection plate furthermore has at least one cutting tool. In one embodiment, the connection plate comprises approximately 2 to approximately 20 cutting tools, more preferably approximately 3 to approximately 8 cutting tools, more preferably approximately 8 cutting tools. The cutting tool is preferably arranged such that a chip can be removed from the rod upon displacement of the connection plate on the rod. In one embodiment, the rod has a recess, for example a groove, into which the cutting tool engages. An initial chip thickness can preferably be set by means of a depth of the engagement of the cutting tool in the recess.

In the event of an impulse or force introduction, the connection plate with the cutting tool is preferably displaced on the rod such that at least the cutting tool at least deforms the material of the rod. In the deformation, the material of the rod is preferably stressed beyond the deformation capability, whereby a chip is created. The chip preferably tears apart into individual lamellae. In a further embodiment, the chip runs away across the cutting tool, preferably across a tool edge.

In one embodiment, the stop element is designed materially connected with the rod; in particular, the stop element is designed as a single part with the rod. In a further embodiment, the stop element is welded to the rod. The stop element is preferably designed as a welded-on component, preferably a welded-on annular element. In a further embodiment, the stop element is part of the rod; in particular, the stop element is comprised by the rod. The stop element is preferably milled from a rod blank. In a further embodiment, the stop element is part of a cast rod.

In the sense of the invention, what is to be understood by "materially connected" is that materially connected components are produced from one piece, or are joined by means of a material joining, for example by means of welding.

In one embodiment, it is provided that a displacement path can be limited by means of a stop element. The displacement path is in particular the path that the connection plate covers in relation to the rod in the event of an accident, or in the event of an impulse or a force introduction into the connection plate. In the sense of the invention, what is meant by the displacement path is the maximum displacement path. The displacement path is preferably, for example, the route between a provided installation position of the connection plate and the stop element.

In one embodiment, it is provided that a displacement path is approximately 5 cm to approximately 60 cm, preferably approximately 20 cm to approximately 60 cm, more preferably approximately 20 cm to approximately 30 cm.

In one embodiment, after the displacement of the connection plate on the rod by essentially the maximum displacement path, an energy conversion via the deformation element is essentially no longer provided. In particular, an impulse or the force introduction after the displacement of the connection plate on the rod by essentially the maximum displacement path is essentially transferred immediately via the joint arrangement, preferably immediately via a joint of the joint arrangement, to a next car.

The stop element preferably limits the path of the connection plate on the rod. In one embodiment, the connection plate comes into contact with the stop element after the maximum displacement path.

In a further embodiment, it is provided that a cutting resistance is increased in a displacement direction. By increasing the cutting resistance, the force introduction into the joint of the joint arrangement is increased with the progression of the displacement of the connection plate. Via such an embodiment, peak stresses are advantageously avoided that, for example, might lead to an uncontrolled fracture in the joint arrangement. In one embodiment, it is provided that the cutting resistance is in particular continuously increased in the displacement direction such that the connection element does not come into contact with the shoulder, preferably independently of the force introduction into the joint arrangement.

The displacement direction is the direction in which the connection plate moves relative to the rod given an impulse or a force introduction at the connection plate, in particular in the event of an accident.

In a further embodiment, it is provided that the stop element comprises a continuous or discontinuous increase in a circumference of the rod in the displacement direction. In one embodiment, what is understood by an increase in the extent of the displacement direction is that the material thickness of the rod increases in the displacement direction.

In a further embodiment, it is provided that the material thickness increases in the displacement direction on two, in particular oppositely situated sides of the rod. In a further embodiment, it is provided that the material thickness increases in the displacement direction on four sides of the rod. In a further embodiment, it is provided that the material thickness increases in the displacement direction over its entire circumference, wherein in particular a [sic] uniformly further over the circumference is preferred the rod is designed such that the chip thickness is increased in the displacement direction. Furthermore, in one embodiment the rod is widened. In one embodiment in which the rod is designed as a tube, a widening is provided given an essentially consistent material thickness.

In one embodiment, the increase in the circumference is a radius increasing in the displacement direction. In a further embodiment, the increase in the circumference is an in particular mirror-symmetrical widening of the rod, or a material accumulation. In a further embodiment, it is provided that the increase in the circumference encompasses a widening on at least two sides. The segment relating to the increase in the circumference is particularly preferably arranged in a region of a cutting path of the cutting tool.

In a further embodiment, it is provided that the stop element comprises at least one shoulder on the rod. In one embodiment, a shoulder is an essentially discontinuous increase in the circumference in the longitudinal direction, preferably in the displacement direction of the rod.

In a further embodiment, the transition region comprises at least two, preferably four opposite widenings. In one embodiment, it is provided that the widening of the shoulder is an essentially horizontal widening given an envisaged use. In one embodiment, it is provided that the widening of the shoulder is an essentially vertical widening given an envisaged use. In one embodiment, it is provided that the widening of the shoulder is an essentially horizontal and vertical widening given an envisaged use. In one embodiment, it is provided that the widening of the shoulder is a widening essentially across the entire circumference given an envisaged use.

In a further embodiment, it is provided that the stop element comprises an at least partially conical, pyramidal or radial transition region. The transition region is a thickening or widening of the rod that in particular opposes the cutting tool with an increased cutting resistance. In one embodiment, the transition region extends across approximately 0.5 cm to 20 cm, preferably approximately 2 cm to approximately 15 cm, more preferably approximately 4 cm to approximately 10 cm, more preferably approximately 0.1 cm to approximately 0.5 cm, in particular in the displacement direction, preferably on the rod. In a further embodiment, the transition region extends from the maximum circumference of the rod, counter to the displacement direction. In a further embodiment, the transition region extends at least in part in a segment that is associated with the joint fork and/or the joint eye. In a further embodiment, it is provided that the transition region is arranged at least in part on the rod.

The transition region preferably increases the cutting resistance that opposes the cutting tool upon displacement of the connection plate on the rod. In one embodiment, the increase of the cutting resistance is constant and/or discontinuous. In one embodiment, the transition region is designed to increase uniformly, in particular in a conical or pyramidal shape. In a further embodiment, the transition region is wavy, preferably with increasing and decreasing material thickness of the rod. In a further embodiment, the transition region has one or more shoulders. In a further embodiment, the transition region has a radius; in particular, the transition region forms a circular arc in a longitudinal section of the rod. In a further embodiment, the transition region comprises at least two, preferably four opposite widenings. In one embodiment, it is provided that the widening of the transition region is an essentially horizontal widening given an envisaged use. In one embodiment, it is provided that the widening of the transition region is an essentially vertical widening given an envisaged use. In one embodiment, it is provided that the widening of the transition region is an essentially horizontal and vertical widening given an envisaged use. In one embodiment, it is provided that the widening of the transition region is a widening essentially across the entire circumference given an envisaged use. The cutting resistance is particularly preferably increased constantly and/or discontinuously, such that the connection plate does not strike the shoulder in the event of a maximum impulse to be expected or a maximum force introduction to be expected on said connection plate, or the connection plate does not reach the highest-situated segment of the shoulder. In one embodiment, the maximum force introduction to be expected is approximately 10000 kN to 15000 kN.

The transition region preferably increases the cutting resistance. The transition region is preferably designed such that the connection plate comes to rest on the shoulder in the event of in particular a maximum impulse to be expected or maximum force introduction to be expected on said connection plate. In a further embodiment, the connection plate comes into contact with or comes to rest on the transition region or the rod. In one embodiment, it is provided that the connection plate wedges or opposes an increased resistance with the transition region. In a further embodiment, it is provided that the connection plate and/or the transition region are plastically and/or elastically deformed in the event of a displacement.

The transition region is preferably designed such that, in the event of a maximum force introduction and/or impulse introduction to be expected, the connection plate cannot be displaced further after the maximum displacement path. In a further embodiment, it is provided that the transition region is designed such that a further displacement of the connection plate is provided in the event of a force introduction and/or impulse introduction that exceeds the maximum force introduction and/or impulse introduction to be expected. The cutting resistance preferably increases constantly in the displacement direction so that in particular a further displacement path is not proportional to the increased force or the increased impulse.

In a further embodiment, it is provided that a veneer is arranged on the rod. The cutting resistance that opposes the cutting tool is modified by means of the veneer. For example, the veneer comprises a material that is soft or more ductile relative to the rod. For example, the cutting tool first cuts into veneer, which in one embodiment comprises a material that is soft relative to the material of the rod, and in one design the cutting tool cuts into the material of the rod itself after a distance in the displacement direction. In a further embodiment, the cutting tool first cuts into the material of the rod, and in one design cuts into the material of the veneer itself after a distance in the displacement direction. In a further embodiment, the cutting tool cuts only into the veneer.

In a further embodiment, it is preferably provided that the veneer comprises a material that is different to the material of the rod. In one embodiment, the tube comprises a steel, for example 1.5 mm (15 GA). In a further embodiment, the veneer comprises a steel, for example StOS, or an aluminum casting alloy, for example AK20.

In a further embodiment, it is provided that a material hardness of the rod and/or of the veneer is different in the displacement direction. In one embodiment, the rod and/or the veneer is thermally treated at least locally, for example by means of a treatment with high-frequency current.

In a further embodiment, it is provided that the joint arrangement comprises a joint fork part and a joint eye part that in particular are connected with one another in an articulated manner by means of a connecting bolt.

In a further embodiment, it is provided that the joint fork part and/or the joint eye part comprises a deformation element. The deformation element of the joint eye part is preferably designed differently to the deformation element of the joint fork part.

In one embodiment, it is provided that the joint eye part comprises a stop element having a shoulder, wherein the joint fork part does not comprise a deformation element. In one embodiment, it is provided that the joint fork part comprises a stop element having a shoulder, wherein the joint eye part does not comprise a deformation element. In one embodiment, it is provided that the joint eye part comprises a stop element having a shoulder, wherein the joint fork part comprises a stop element having a transition region. In one embodiment, it is provided that the joint fork part comprises a stop element having a shoulder, wherein the joint eye part comprises a stop element having a transition region. In one embodiment, it is provided that the joint eye part comprises a stop element having a shoulder, wherein the joint fork part comprises a stop element having a shoulder. In one embodiment, it is provided that the joint eye part comprises a stop element having a transition region, wherein the joint fork part comprises a stop element having a transition region. In one embodiment, it is provided that the joint eye part comprises a stop element having a transition region, wherein the joint fork part does not comprise a deformation element. In one embodiment, it is provided that the joint fork part comprises a stop element having a transition region, wherein the joint eye part does not comprise a deformation element.

In one embodiment, it is provided that the widening of the transition region of the joint fork part is an essentially horizontal widening given an envisaged use. In one embodiment, it is provided that the widening of the transition region or of the shoulder of the joint fork part is an essentially vertical widening given an envisaged use. In one embodiment, it is provided that the widening of the transition region or of the shoulder of the joint fork part is an essentially horizontal and vertical widening given an envisaged use. In one embodiment, it is provided that the widening of the transition region or of the shoulder of the joint fork part is a widening essentially across the entire circumference given an envisaged use.

In one embodiment, it is provided that the widening of the transition region or of the shoulder of the joint eye part is an essentially horizontal widening given an envisaged use. In one embodiment, it is provided that the widening of the transition region or of the shoulder of the joint eye part is an essentially vertical widening given an envisaged use. In one embodiment, it is provided that the widening of the transition region or of the shoulder of the joint eye part is an essentially horizontal and vertical widening given an envisaged use. In one embodiment, it is provided that the widening of the transition region or of the shoulder of the joint eye part is a widening essentially across the entire circumference given an envisaged use.

In a further embodiment, it is provided that a joint fork and/or a joint eye is connected as one piece with the rod. In particular, the joint fork and/or the joint eye is materially connected with the rod.

In a further embodiment, it is provided that the at least one stop element is associated with the joint fork and/or the joint eye. In a further embodiment, it is provided that the joint fork and/or the joint eye at least partially comprises the at least one stop element. In a further embodiment, it is provided that the at least one stop element is at least partially connected, in particular materially connected, with the joint fork and/or the joint eye. In a further embodiment, it is provided that the at least one stop element in particular immediately adjoins the joint eye and/or the joint fork. In a further advantageous embodiment, the at least one stop element and/or the rod and/or the joint eye and/or the joint rod [sic] are designed materially connected. The embodiments cited above have the advantage that a very compact and relatively lightweight embodiment of a joint arrangement is achieved.

Furthermore, a method for energy conversion by means of a Jacobs bogie, comprising a joint arrangement described above, is proposed, wherein the joint arrangement comprises at least one deformation element, wherein the deformation element comprises at least one rod and a connection plate. The rod has at least one stop element. The connection plate can be displaced on the rod in the longitudinal direction of said rod, wherein a deformation work can be performed on the deformation element given a displacement of the connection plate on the rod, and wherein a displacement path of the connection plate on the rod is limited by the stop element.

The connection plate is preferably displaced on the rod by means of an introduction of force. In one embodiment, it is provided that, in the event of a force introduction into the connection plate, a flow of force is conducted from the connection plate directly into the rod.

In one embodiment, it is provided that the connection plate comprises at least one cutting tool, wherein the connection plate is displaced on the rod and the cutting tool removes at least one chip from the rod. In a further embodiment, it is provided that a force introduced into the connection plate is transferred at least partially into the rod via the cutting tool. In particular, the force is at least partially introduced into the rod via the cutting tool after the complete displacement of the connection plate along the displacement path. In a further embodiment, the force is directly introduced at least in part from the connection plate into the rod after the complete displacement of the connection plate along the displacement path. In a further embodiment, it is provided that a force introduced into the connection plate via the cutting tool is at least partially conducted into the rod, wherein after displacement along the maximum displacement path the force is introduced directly from the connection plate into the rod, in particular into a shoulder of the rod at which the connection plate rests.

In one embodiment, it is provided that a displacement path is limited by means of a stop element. In a further embodiment, the connection plate comes into contact with a shoulder of the stop element. The one partial surface of the connection plate preferably strikes against the shoulder. In one embodiment, the shoulder is designed such that a distance between a stop face of the shoulder and the connection plate corresponds, in the provided installation state, to the maximum displacement path of the connection plate on the rod.

In a further embodiment, it is provided that a cutting resistance for the cutting tool is varied discontinuously and/or constantly by means of the stop element.

In a further embodiment, it is provided that the cutting resistance is increased. In particular, a constantly or discontinuously increased material thickness opposes the cutting tool.

In one embodiment, the cutting tool is positioned in a recess or groove in the rod. In the event of a force or an impulse on the connection plate, the cutting tool is moved in the displacement direction, wherein in particular a chip is removed by means of the cutting tool. In one embodiment, the material thickness of the rod is increased in the displacement direction, such that the cutting tool removes an increasingly thicker chip in the displacement direction.

The energy conversion is preferably controlled by means of the chip removal. In the event of an accident, the energy conversion may be at least partially controlled with the proposed device and the method.

Figure 2:
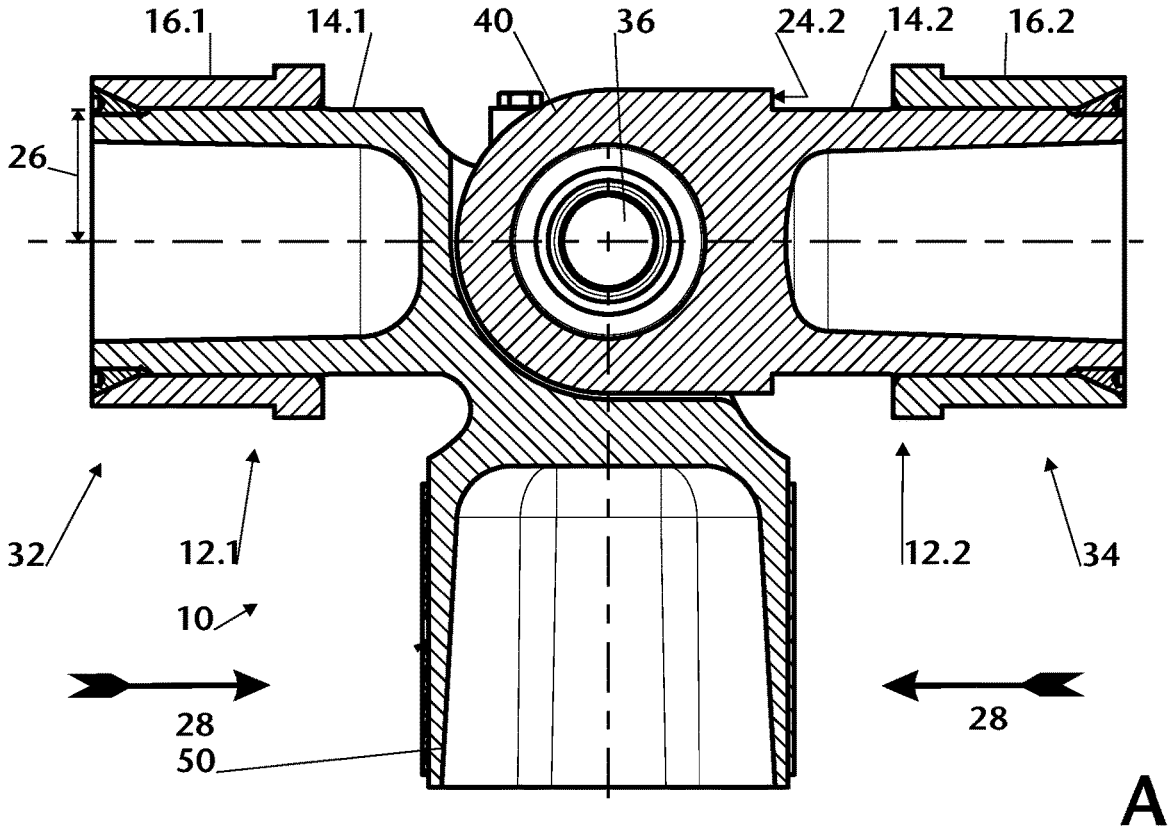
Figure 2:
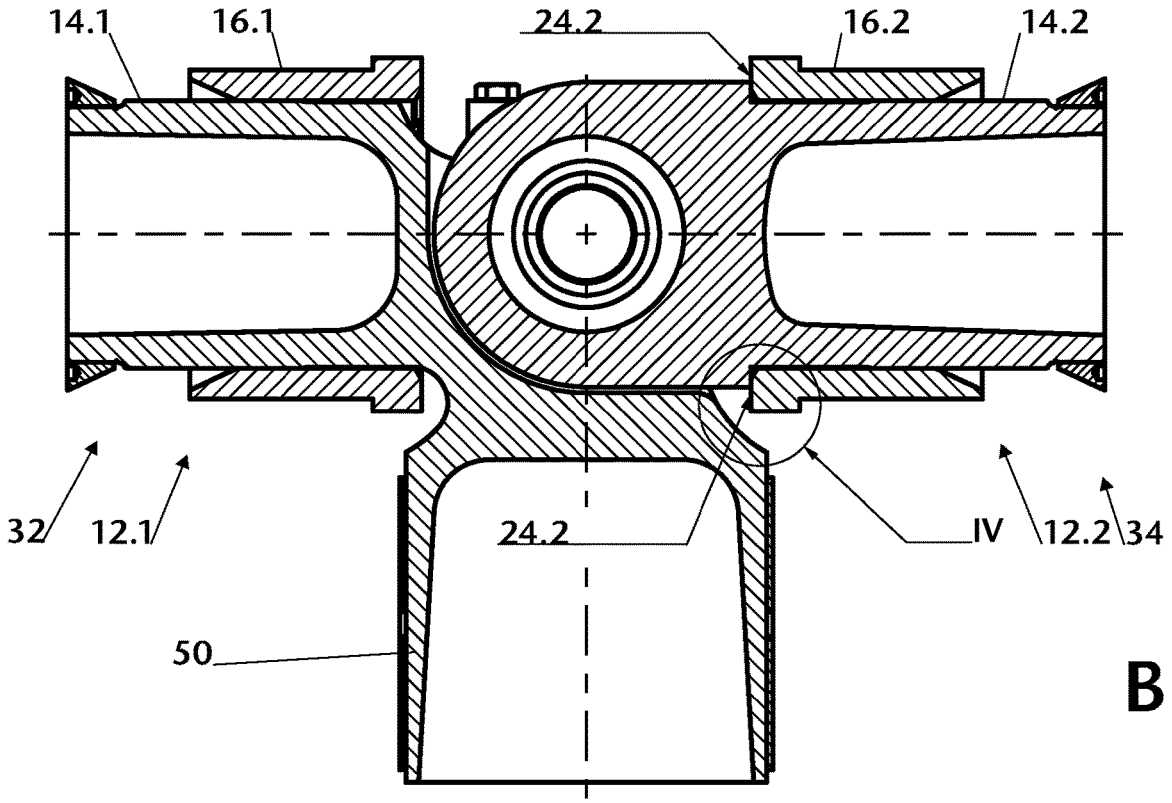
Figure 3:
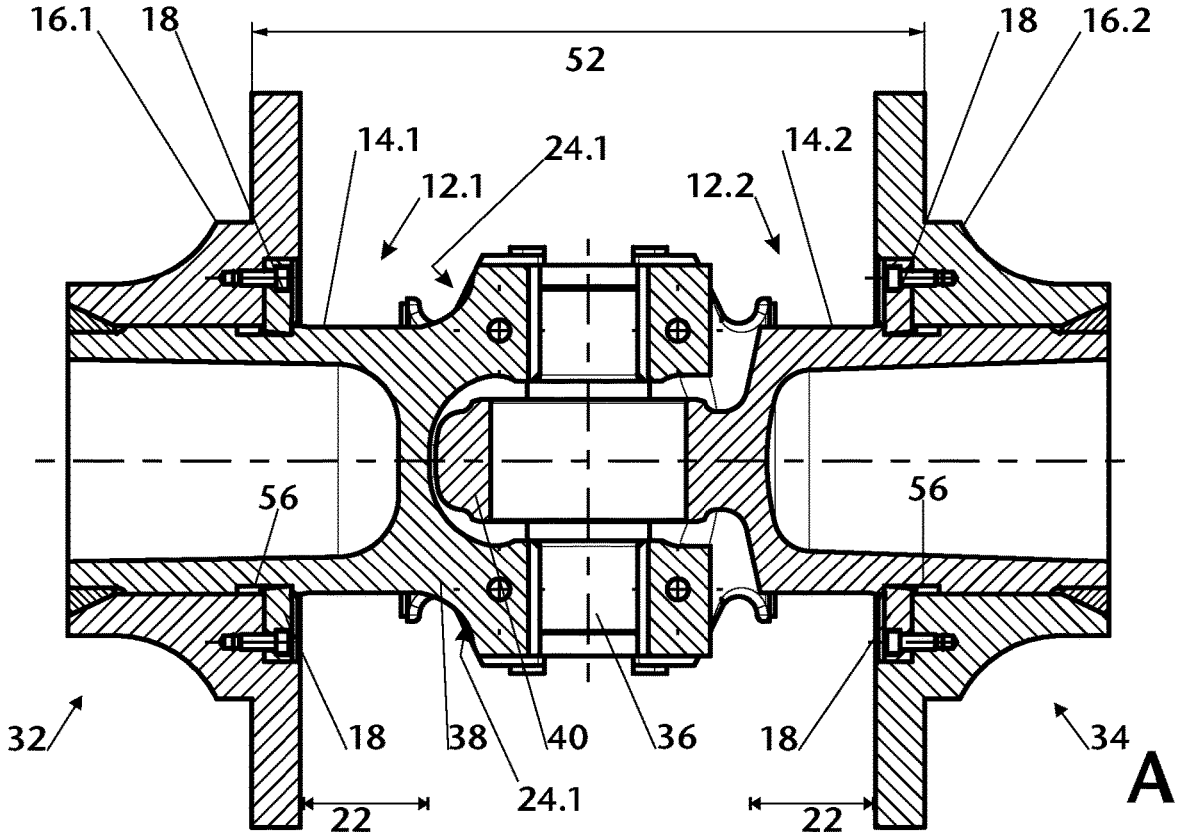
Figure 3:
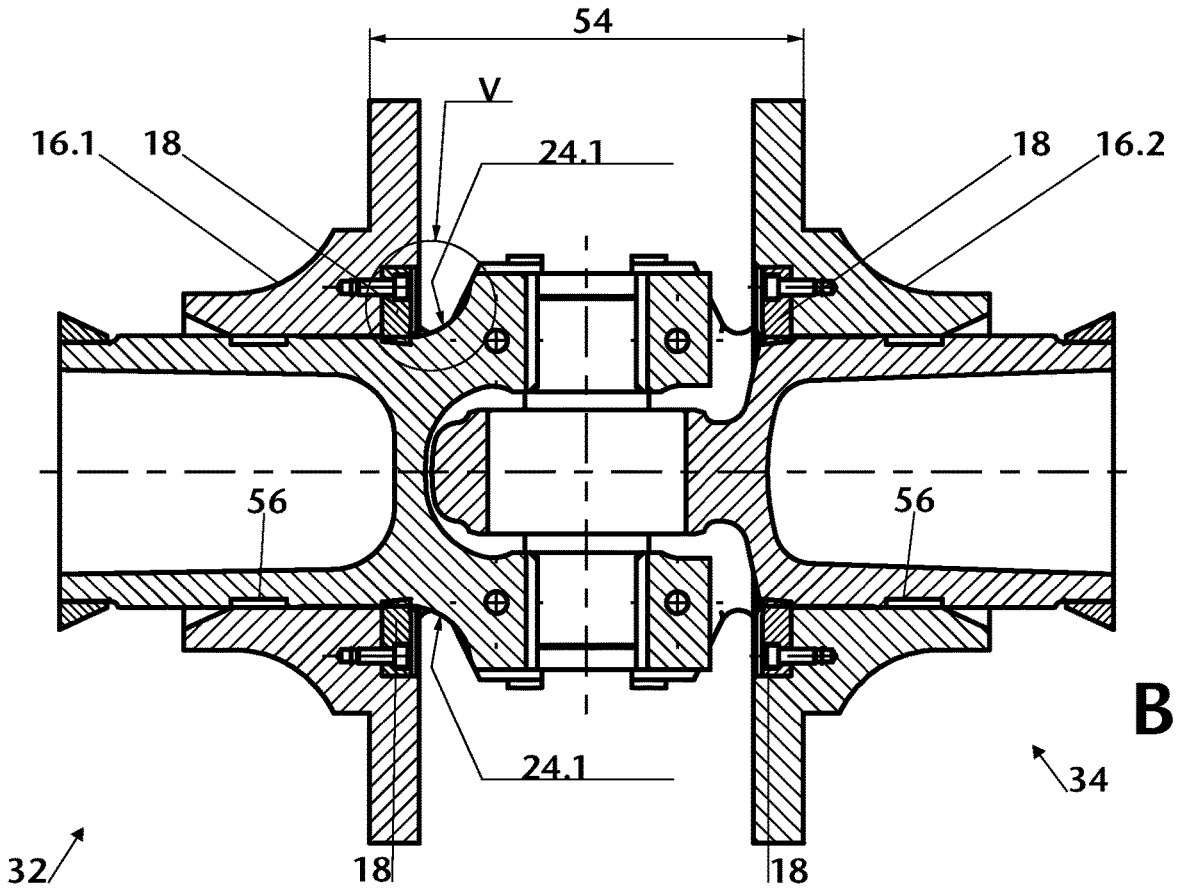
Figure 4:
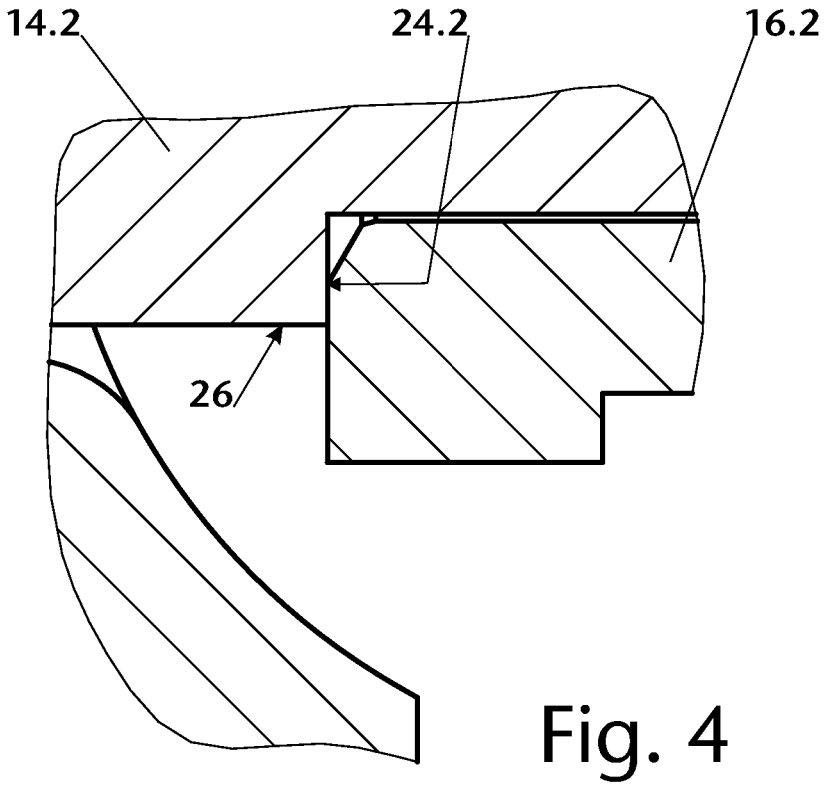

Additional advantageous embodiments arise from the following drawings. However, the developments presented there are not to be construed as limiting; rather, the features described there may be combined with one another and with the features described above to form additional embodiments. Furthermore, it is to be noted that the reference characters indicated in the figure description do not limit the protective scope of the present invention, but rather merely refer to the exemplary embodiments shown in figures. Identical parts, or parts having the same function, have the same reference characters in the following. Shown are:

FIG. 1A a joint arrangement before an accident;

FIG. 1B a joint arrangement after an accident;

FIG. 2A the joint arrangement before an accident, in a vertical longitudinal section;

FIG. 2B the joint arrangement after an accident, in a vertical longitudinal section;

FIG. 3A the joint arrangement before an accident, in a horizontal longitudinal section;

FIG. 3B the joint arrangement after an accident, in a horizontal longitudinal section;

FIG. 4 a detail view IV from FIG. 2B; and

Figure 5:
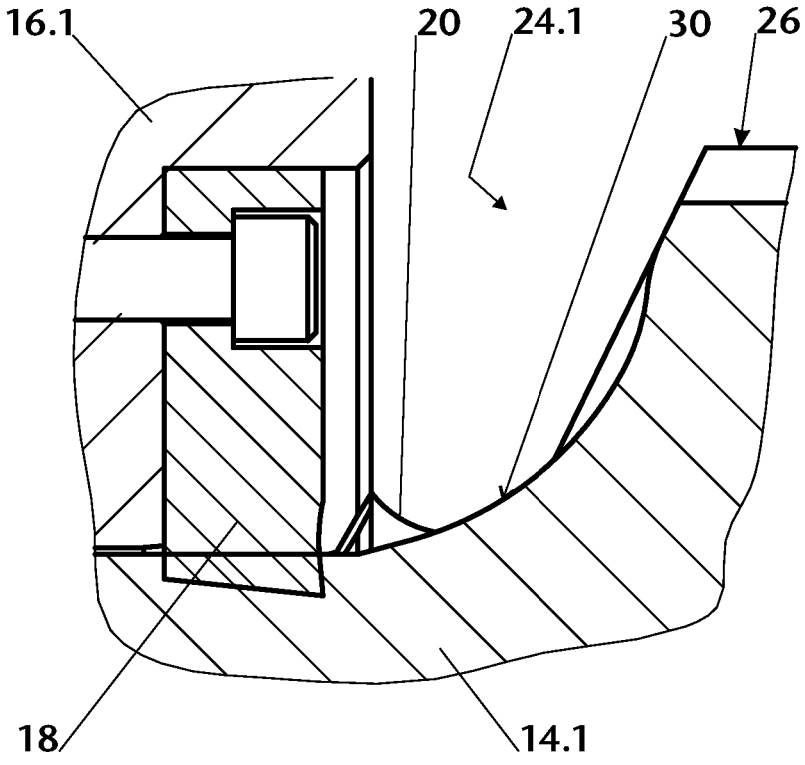

FIG. 5 a detail view V from FIG. 3B.

FIGS. 1A and 1B show a joint arrangement 10 for a truck (not depicted), in particular a Jacobs bogie. FIG. 1A shows the joint arrangement before an accident, in a horizontal regular installation state. FIG. 1B shows the same joint arrangement after an accident, or after an introduction of a force that maximally loaded the deformation elements 12 without causing a destruction of the joint arrangement 10.

The joint arrangement 10 comprises a joint fork part 32 and a joint eye part 34. The joint eye part 34 has a joint eye 40, and the joint fork part 32 has a joint fork 38. Joint fork 38 and joint eye 40 are connected with one another by means of a connecting bolt and form a joint. The joint fork part 32 comprises a first connection plate 16.1, and the joint eye part comprises a second connection plate 16.2. The connection plates 16.1, 16.2 are arranged on a rod 14.1 and 14.2 respectively. At least one connection plate 16, a rod 14, and a cutting tool 18 form a deformation element 12. The connection plates 16.1, 16.2 can be attached to cars (not shown) of a train. A pin 50 is connected with a lower part (not shown) of the truck.

FIG. 2A and FIG. 2B show a vertical longitudinal section through the joint arrangement from FIG. 1A and FIG. 1B. FIG. 2A shows the joint arrangement before an accident, or in a regular installation state. FIG. 2B shows the same joint arrangement after an accident, or after an introduction of force that maximally loaded the deformation elements 12.1, 12.2 without causing a destruction of the joint arrangement 10.

The joint eye 40 is arranged in the joint fork 38, wherein these are connected with one another by means of the joint pin 36. The joint eye 40 is connected in one piece and materially joined with the rod 14.2, and forms the joint eye part 34. The connection plate 16.2 is arranged on the rod 14.2 and with this forms the deformation element 12.2. The joint fork 36 is connected in one piece with the rod 14.1 and forms the joint fork part 32. The connection plate 16.1 is arranged on the rod 14.1 and with this forms the deformation element 12.1. The rods 12.1 and 12.2 are essentially hollow in design.

If the connection plates 16.1 and 16.2 from FIG. 2A move towards each another in the displacement direction 28, in the shown embodiment the connection plate 16.2 is limited in its movement by means of a shoulder of a stop element 24.2 of the joint eye part 34, which shoulder is formed materially connected with the joint eye 40 or the rod 14.2. As is apparent in FIG. 2B, upon displacement by the maximum displacement path 22, which is shown in FIG. 3A, the connection plate 16.2 comes into contact with the shoulder 24.2. If the connection plate 16.2 is in contact with the shoulder 24.2, an additional force introduction into the connection plate 16.2 is introduced directly from the connection plate 16.2 into the shoulder 24.2 or into the rod 12.2.

FIG. 3A and FIG. 3B show a horizontal longitudinal section through the joint arrangement from FIG. 1A and FIG. 1B. FIG. 3A shows the joint arrangement before an accident, or in a regular installation state. FIG. 3B shows the same joint arrangement after an accident, or after an introduction of a force that maximally loaded the deformation elements 12.1, 12.2 without creating a destruction of the joint arrangement 10. A difference in the lengths 52 and 54 is the sum of the two maximum displacement paths 22 of the deformation elements 12.1 and 12.2.

The cutting tools 18 are arranged, in particular bolted tightly, on the connection plates 16.1, 16.2. It is to be learned from FIG. 3A that the cutting tools 18 engage in recesses 56. If the connection plate 16.1 moves in the movement direction 28 (again not drawn here for reasons of clarity), the movement of the connection plate 16.1 is limited by a stop element 24.1 materially connected with the joint fork 36 or the rod 14.1. In contrast to the stop element 24.2 from FIG. 2, the stop element 24.1 is not designed as a shoulder but rather is characterized by a continuously increasing material thickness of the rod 14.1. An increased cutting resistance opposes the cutting tool 18, which cutting resistance limits the movement of the connection plate 16.1. The maximum displacement path 22 of the connection plate 16.1 is achieved when the cutting resistance is approximately so great that, even in an accident situation, the force introduction into the connection plate is not sufficient to lift an additional chip off of the rod 12.1. The force introduction from the connection plate 16.1 into the rod 12.1 also takes place via the cutting tool 18 after the displacement of the connection plate 16.1 by the maximum displacement path 22.

As is apparent from FIGS. 2A and 2B in conjunction with FIGS. 3A and 2B, a widening of the rod 12.2 that forms the shoulder 24.2 is formed essentially only in the vertical direction. Furthermore, as is apparent from FIGS. 2A and 2B in conjunction with FIGS. 3A and 2B, a widening of the rod 12.1, said widening forming the transition region 24.1, is formed essentially only in the horizontal direction.

FIG. 4 shows a detail view IV of FIG. 2B, from which it is apparent that the connection plate 16.2 comes into contact with the stop element 24.2 that is designed as a shoulder 26.

FIG. 5 shows a detail view V of FIG. 3B, from which it is apparent that the connection plate 16.1 has a cutting tool 18 that cuts into the material of the rod 14.1 and lifts off a chip 20. The stop element 24.1 has a transition region 30 that runs in a circular arc at least in part in the shown section view. By means of the transition region 30, the cutting resistance is increased continuously so that the movement of the connection plate 16.1 on the rod 14.1 is limited, in particular without coming into contact with the shoulder 26. In a further embodiment, or in the event of a defined introduction of force or impulse, the connection plate 16.1 comes into contact with the transition region 30 and thus a displacement resistance increases.

The invention claimed is:

1. A joint arrangement for a truck, comprising:

at least one deformation element, wherein the deformation element comprises at least one rod, a joint fork part, and a joint eye part; and a connection plate, wherein the connection plate is arranged on the rod,
the rod has at least one stop element,
the connection plate is displaceable on the rod in the longitudinal direction of the rod,
a deformation work is to be performed at the deformation element in the event of a displacement of the connection plate on the rod, and
a displacement path of the connection plate on the rod is limited by the stop element.

2. The joint arrangement according to claim 1, wherein the connection plate comprises a cutting tool by means of which at least one chip is removable from the rod upon displacement of the connection plate on the rod.

3. The joint arrangement according to claim 1, wherein the stop element comprises a constant or discontinuous increase in a circumference of the rod in a displacement direction.

4. The joint arrangement according to claim 1, wherein the stop element is designed as a shoulder on the rod.

5. The joint arrangement according to claim 1, wherein the stop element comprises an at least partially conical or radial transition region.

6. The joint arrangement according to claim 1, wherein a veneer is arranged on the rod.

7. The joint arrangement according to claim 6, wherein the veneer comprises a material that is different to the material of the rod.

8. The joint arrangement according to claim 1, wherein a material hardness of the rod is different in the displacement direction.

9. The joint arrangement according to claim 1, wherein the joint fork and/or the joint eye is connected as one part with the rod.

10. The joint arrangement according to claim 1, wherein the stop element is designed materially connected with the rod.

11. A method comprising:
converting energy through a joint arrangement in a truck, wherein the joint arrangement comprises at least one deformation element comprising at least one rod, a joint fork part, and a joint eye part; and a connection plate, wherein
the connection plate is arranged on the rod,
the rod has at least one stop element,
the connection plate is displaceable on the rod in the longitudinal direction of the rod,
a deformation work is to be performed at the deformation element in the event of a displacement of the connection plate on the rod, and
a displacement path of the connection plate on the rod is limited by the stop element.

12. The method according to claim 11, further comprising in response to a force introduction into the connection plate, conducting a flow of force from the connection plate directly into the rod.

13. The method according to claim 11, wherein the connection plate is displaced on the rod and comprises at least one cutting tool, and the method further comprises removing at least one chip from the rod through the cutting tool.

14. The method according to claim 11, further comprising varying a cutting resistance for the cutting tool discontinuously and/or constantly through the stop element.

15. The method according to claim 14, further comprising increasing the cutting resistance.

16. A joint arrangement for a vehicle, comprising:
at least one deformation element, wherein the deformation element comprises at least one rod, a joint fork part, and a joint eye part; and
a connection plate, wherein
the connection plate is arranged on the rod,
the rod has at least one stop element,
the connection plate is displaceable on the rod in the longitudinal direction of the rod,
a deformation work is to be performed at the deformation element in the event of a displacement of the connection plate on the rod, and
a displacement path of the connection plate on the rod is limited by the stop element.

17. The joint arrangement according to claim 16, wherein the vehicle comprises one of a truck, a car, or a railway vehicle.

18. The joint arrangement according to claim 16, wherein the stop element comprises one or more of:
a constant or discontinuous increase in a circumference of the rod in a displacement direction,
a shoulder on the rod, or
an at least partially conical or radial transition region on the rod.

* * * * *